US010285476B2

(12) United States Patent
Cianflone

(10) Patent No.: US 10,285,476 B2
(45) Date of Patent: May 14, 2019

(54) METHOD FOR PRODUCING AN ORNAMENTAL PIECE HAVING INTERTWINED RINGS

(71) Applicant: Alessia Cianflone, San Diego, CA (US)

(72) Inventor: Alessia Cianflone, San Diego, CA (US)

( * ) Notice: Subject to any disclaimer, the term of this patent is extended or adjusted under 35 U.S.C. 154(b) by 306 days.

(21) Appl. No.: 15/507,739

(22) PCT Filed: Aug. 24, 2015

(86) PCT No.: PCT/FR2015/052255

§ 371 (c)(1),
(2) Date: Feb. 28, 2017

(87) PCT Pub. No.: WO2016/030622

PCT Pub. Date: Mar. 3, 2016

(65) Prior Publication Data

US 2017/0290397 A1 Oct. 12, 2017

Related U.S. Application Data

(63) Continuation of application No. PCT/FR2015/052255, filed on Aug. 24, 2015.

(30) Foreign Application Priority Data

Aug. 29, 2014 (FR) ..... 14 01931

(51) Int. Cl.
*B21F 3/04* (2006.01)
*A44C 27/00* (2006.01)
(Continued)

(52) U.S. Cl.
CPC ..... *A44C 27/002* (2013.01); *A44C 25/001* (2013.01); *A44C 27/00* (2013.01);
(Continued)

(58) Field of Classification Search
CPC .. Y10T 29/49588–29/49593; Y10T 29/49597; A44C 27/00;
(Continued)

(56) References Cited

U.S. PATENT DOCUMENTS 31,931 A * 4/1861 Kipling ..... A44C 5/0092 63/11
353,464 A 11/1886 Sawyer
(Continued)

FOREIGN PATENT DOCUMENTS

EP 1319350 A2 6/2003
GB 1206595 A 9/1970

*Primary Examiner* — Matthew P Travers
(74) *Attorney, Agent, or Firm* — Coastal Patent Law Group, P.C.

(57) ABSTRACT

The disclosure concerns a method for producing an ornamental piece, comprising a step of forming a first, closed ring (32), comprising a step of cutting out a first template comprising a sheet of base material configured to be cut out and pierced, and a step of at least partial winding of the first template with a first set of threads; a step of forming a second, open ring (33), comprising a step of cutting out a second template (43) comprising a sheet of base material configured to be cut out and pierced and a step of partial winding of the second template (43) with a second set of threads (24); a step of intertwining the second ring (33), comprising partial winding of the second template (43) with the first ring (32), comprising at least partial winding of the first template; and a step of closing the second ring (33).

13 Claims, 2 Drawing Sheets

(51) Int. Cl.

| | |
|---|---|
| ***A44C 25/00*** | (2006.01) |
| *A44C 7/00* | (2006.01) |
| *A44C 11/00* | (2006.01) |
| *A44C 15/00* | (2006.01) |
| *B21F 43/00* | (2006.01) |

(52) U.S. Cl.
CPC ..... *A44C 7/00* (2013.01); *A44C 11/00* (2013.01); *A44C 15/005* (2013.01); *B21F 3/04* (2013.01); *B21F 43/00* (2013.01)

(58) Field of Classification Search
CPC ..... A44C 27/001–27/002; A44C 11/00; A44C 15/005; A44C 5/02; A44C 5/00; A44C 5/0084–5/0092; A44C 7/00; A44C 7/002; A44C 9/00; A44C 9/0015; A44C 25/001; A44C 27/005–27/006; B21L 11/005; B21F 3/04; B21F 43/00
See application file for complete search history.

(56) References Cited

U.S. PATENT DOCUMENTS 886,616 A * 5/1908 Long ..... B21C 37/0815 228/151
1,514,962 A * 11/1924 Grimaldi ..... A45B 25/12 135/37
2,263,384 A * 11/1941 Grimaldi ..... A45B 25/12 135/37
2,840,983 A * 7/1958 Keilbach ..... A44C 11/00 59/83
4,711,800 A * 12/1987 DiVincenzo ..... C23F 1/04 216/108
5,203,182 A * 4/1993 Wiriath ..... A44C 5/00 138/110
2002/0134106 A1* 9/2002 Antonio ..... A44C 11/00 63/4
2003/0010059 A1* 1/2003 Cerato ..... A44C 11/00 63/37
2003/0074881 A1* 4/2003 Chia ..... A44C 11/00 59/80
2003/0110633 A1 6/2003 Disegna et al.
2003/0213225 A1* 11/2003 Disegna ..... A44C 27/00 59/35.1
2009/0094959 A1* 4/2009 Cerato ..... A44C 27/006 59/1
2010/0281918 A1* 11/2010 Colpo ..... A44C 11/00 63/3.1
2016/0003580 A1* 1/2016 Zafar ..... F41H 1/02 245/4
2016/0007698 A1* 1/2016 Rauch ..... A44C 15/005 63/3
2016/0281820 A1* 9/2016 Wienke ..... B66C 1/125

* cited by examiner

METHOD FOR PRODUCING AN ORNAMENTAL PIECE HAVING INTERTWINED RINGS

CROSS-REFERENCE TO RELATED APPLICATIONS

This application is a national phase entry claiming benefit of PCT/FR2015/052255, filed Aug. 24, 2015;

which further claims benefit of FR 1401931, filed Aug. 29, 2014;

the contents of each of which are hereby incorporated by reference.

BACKGROUND

Field of the Invention

The present application relates to a method for producing an ornamental piece; and more particularly, to producing a three-dimensional ornamental piece.

Description of the Related Art

Wound ornamental pieces are for example known, such as curtain tiebacks.

However, to produce such three-dimensional pieces, massive templates are generally used, making the pieces heavy and limiting the possible arrangements of the templates relative to one another.

The present disclosure aims to at least partially resolve the aforementioned drawbacks, also leading to other advantages.

SUMMARY

To that end, according to a first aspect, a method is proposed for producing an ornamental piece, characterized in that it comprises:

a step of forming a first, closed ring, including a step of cutting out a first template including a sheet of base material configured to be cut out and pierced, and a step of at least partial winding of the first template with a first set of threads or "filaments";

a step of forming a second, open ring, including a step of cutting out a second template including a sheet of base material configured to be cut out and pierced and a step of partial winding of the second template with a second set of filaments;

a step of intertwining the second ring, including partial winding of the second template with the first ring, including at least partial winding of the first template; and a step of closing the second ring.

It is thus possible to obtain a lightweight and three-dimensional ornamental piece.

Unlike solid pieces, which are heavy and rigid, it is then possible and easy to produce intertwined structures, twist the templates, pierce them, sew them and/or embroider them.

According to one example embodiment, the second template includes a cutout and the step for closing the second ring includes a step for sewing the cutout and a step for finishing the winding of the second template.

It is thus possible to form a flat ring, for example.

According to one interesting embodiment, the method includes a step for embroidering at least one of the first ring or the second ring, in which at least one of the first template or the second template is pierced.

The embroidery is for example done with stones or pearls. This makes it possible to give the piece a relief.

According to another interesting embodiment, the method includes a step for folding at least one of the first template, at least partially wound, or the second template, at least partially wound.

It is then easy to impart various three-dimensional shapes to the piece.

According to one particular embodiment, at least one of the first template or the second template further includes a foam configured to provide a thickness to the template, and at least one of the steps for cutting out the first template or the step for cutting out the second template includes a step for cutting out a first piece in the sheet of base material and a step for cutting a second piece, having the same shape as the first piece, from a foam, and the method includes a step for gluing the first piece to the second piece.

This makes it possible to make at least one of the rings more imposing, while also making it possible to bend and/or embroider it, for example.

For instance, at least one of the step for at least partial winding of the first template and the step for partial winding of the second template includes a step for gluing an initial end of at least one of the first set of filaments or the second set of filaments on one of the first template or the second template using a hot-melt adhesive. This facilitates the winding of the templates.

According to another example, at least one of a step for finishing winding of the first template or the step for finishing winding of the second template includes a step for gluing a terminal end of at least one of the first set of filaments or the second set of filaments on one of the first template or the second template using a liquid adhesive. This makes it possible to fasten the filaments on the templates easily, without having to use a fastening element that could needlessly make the piece heavier and possibly unbalance it.

According to one convenient embodiment, the method includes a step for attaching a fastener to one of the first template or the second template, and the step for fastening a fastener is carried out before the step for least partial winding of the first template or the step for partial winding of the second template. The fastener is thus concealed, as discreetly as possible.

According to one interesting option, the method includes a step for sewing the first ring and the second ring to one another. This makes it possible to better establish their spatial arrangement relative to one another.

BRIEF DESCRIPTION OF THE DRAWINGS

The invention according one example embodiment will be well understood, and its advantages will better appear, upon reading the following detailed description, provided for information and not limitation, with reference to the appended drawings, in which.

DETAILED DESCRIPTION OF THE PREFERRED EMBODIMENTS

Figure 1:
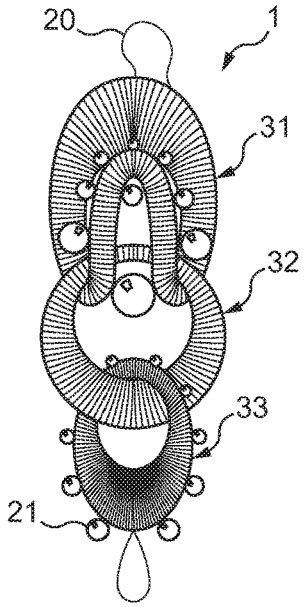
FIG. 1 shows a schematic example of an ornamental piece, according to one example embodiment of the present invention, including three rings, two rings of which are intertwined.

Now turning to the Drawings, the elements shown in the aforementioned figures are identified using numerical references.

In the context of the present description with reference to FIGS. 1 to 5, the ornamental piece 1 comprises an earring. That being said, the ornamental piece 1 could be any jewelry, or could be of any nature. FIG. 6 for example shows a necklace made according to an example embodiment of the present invention.

An ornamental piece 1 as shown in FIGS. 1 to 5 here includes three rings 31, 32, 33 each formed by a template 41, 42, 43 wound by at least one set of filaments 22, 23, 24.

Each template can be bent, woven, twisted and threaded with another template.

Here, the ornamental piece 1 includes a hook 20 fastened to a ring 31, called first ring 31, so as to be able to be attached to an ear, for example.

Here, the first ring 31 is bent on itself while threading in and surrounding a second ring 32. Two separate points of the first ring 31 can next be sewn, for example to prevent the second ring 32 from detaching.

The ornamental piece 1 further includes a third ring 33 that is interwoven with the second ring 32, according to one embodiment of the present invention.

Thus, the present example of an ornamental piece only includes two rings interwoven with one another, which are the second ring 32 and the third ring 33. According to one alternative that is not shown, the second ring 32 could nevertheless also be interwoven with the first ring 31, or the third ring 33 could simultaneously be interwoven with the second ring 32 and the first ring 31.

To produce the ornamental piece 1, a preliminary step for example consists of designing and drawing a model, to be chosen from forms of rings, winding filaments and embroidery stones or pearls.

Figure 2:
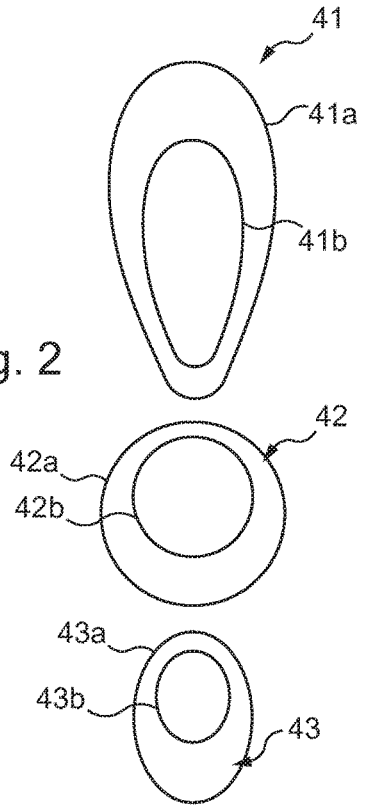
FIG. 2 illustrates a step for forming the rings of the ornamental piece of FIG. 1 from a cutout of three templates.
Figure 3:
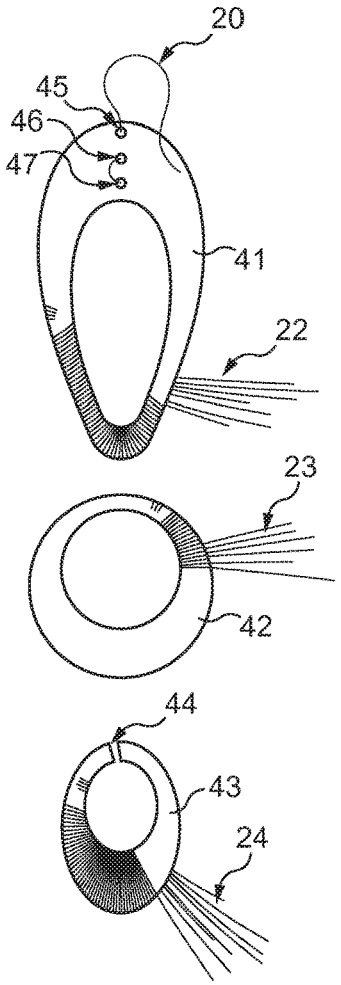
FIG. 3 illustrates a step for fastening an earring hook and a step for at least partial winding of each of the three rings of the ornamental piece of FIG. 1, seen from the back, one of the rings then being open to be able to be interwoven with another ring.

As shown more precisely by FIGS. 2 and 3, a ring in the context of the present description may assume various forms.

A first template 41, serving to form the first ring 31, here has an ovoid shape. It is further particularly elongated in one direction, defining a longitudinal direction, so as to facilitate its threading in a second template 42, serving to form the second ring 32, while for example allowing it to subsequently bend on itself. It includes an outer contour 41*a* and an inner contour 41*b* each having an ovoid shape defining a band of variable width between them due to the fact that the shape of the inner contour 41*b* here is off-centered relative to the shape of the outer contour 41*a*. The same is true for a third template 43, serving to form the third ring 33, which includes an ovoid inner contour 43*b* that is off-centered relative to the ovoid shape of its outer contour 43*a*. The second template 42 differs from the previous ones in that it includes a circular outer contour 42*a* and inner contour 42*b*. However, the shape of the inner contour 42*b* is off-centered relative to the outer contour 42*a*, such that the second template is also formed by a band of variable width.

Thus, in general, the inner contour and the outer contour of the templates can have homothetic shapes, centered relative to one another or off-centered, or contours with different shapes.

Thus, to produce each template, each shape, representing the contours of the templates, is first drawn, for example with a thin permanent marker, on a sheet of a base material having a chosen thickness, on a 1:1 scale. It is for example possible to use stencils, square and/or compass if needed. Each template is then cut out, for example using a professional cutter to be produced as precisely as possible.

The sheet of base material used for at least one template is for example a sheet of polyvinyl chloride (PVC) having a thickness comprised between about 0.1 mm and about 0.6 mm. Of course, if the ornamental piece includes several rings, each of the templates can be formed from a different sheet of base material, i.e., from different materials and/or materials having different thicknesses from one another.

Once cut, an optional step consists of filing the edges that have been cut to make them regular and slightly creased so as to allow the filaments, which will next be threaded, to attach better and not slip, in particular during the first winding revolution.

Depending on the number, types of shapes and assembly of the templates of the desired model, it is also possible to vary the thickness of each template.

One optional step can then consist of giving a thickness to at least one of the templates. To that end, the template for example includes foam. The foam is for example a foam sheet of polymer. The foam sheet for example has a thickness comprised between about 1 mm and about 3 mm.

To that end, it is for example necessary to cut out a shape in the foam that is the same as that cut out in the sheet of base material and adhere it on top. The template then has a homogenous thickness.

Once the template is defined, if the targeted model must be attached (for example, like an earring or pin) or must include a clasp (like a necklace or bracelet), one step consists of incorporating a fastener. The fastener is for example made from chrome, brass, copper, silver or gold.

In the present example, this involves fastening a hook 20. Here, the hook 20 is fastened on the first template 41, as shown in FIG. 2.

To that end, the template is pierced with at least one hole. Here, the first template 41 includes three holes 45, 46, 47. The hook 20, which here is a curved metal rod, is passed through the holes as shown by FIG. 2, in rear view, and FIG. 3, in front view. Optionally, part of the hook 20 is flattened while forming an S with a lower end gripped against the template to protrude therefrom as little as possible, for example owing to a clamp. This also allows the hook to be solidly attached to the template and next to be as discreet as possible when the templates are wound to form the rings.

Optionally, hot-melt adhesive contributes to better fastening.

Likewise, it is possible to attach any type of charm to the template before winding, such as stones, pearls or the like.

Of course, the same approach will also be used to attach a fastener or charm to any ring, in particular a ring configured to be interwoven with another ring, for example the second ring or the third ring.

A hot-melt adhesive mentioned this application is for example an adhesive that is flexible and elastic enough after it has dried (it does not vitrify) to allow an embroidery needle to pass through it and therefore to allow sewing on a template, for example. To that end, one particularly convenient adhesive is for example an adhesive with a base of ethylene vinyl acetate, polyolefin, polyamide, polyurethane or copolymer.

To wind each of the templates, configured to form the rings, one step for example consists of selecting sets of filaments 22, 23, 24, for example a first set of filaments 22 for the first ring 31, a second set of filaments 23 for the second ring 32 and a third set of filaments 24 for the third ring 33.

Each set of filaments possibly includes one or several filaments, in one or several colors or materials. Each of the filaments is for example a rayon, silk, wool, cotton, polyester, polyamide, aramid, potentially lusterless or metallized filament.

Here, each set of filaments includes several filaments, a length of which is chosen based on the template to be wound, i.e., for example 30 cm for a small template, or 2 m or 3 m for a larger template. The filaments of each set here are identical, but each set here is different from the others such that each ring has a different color from the other rings.

The ends, here called initial ends, of each of the filaments of a set of filaments are all aligned. To that end, the set of filaments can for example be cut at the initial end. The initial end of the filaments of the set of filaments is next for example adhered on the corresponding template with a drop of hot-melt adhesive. The drop of hot-melt adhesive is preferably flattened before cooling so as only to form a film of adhesive on the filaments. This is for example done by pressing a metal blade on the drop of adhesive on the template.

The winding is next done by surrounding the template, i.e., by winding the corresponding set of filaments around the band defined by the inner contour on the one hand, and the outer contour on the other hand, of the corresponding template.

Based on the dimensions of the inner contour, the winding can be done by passing the set of filaments directly through the center of the template, or using a hook, for example having a 0.8 mm head. Several revolutions are possibly done so that the template is hidden. This further makes it possible to create a consistent and thick textile structure so as also to provide the possibility of embroidering pearls 21 or other elements on these filaments later.

According to another example embodiment that is not shown, the winding step can also include an alternative step of winding several sets of filaments so as to produce different visual effects. All of the sets of filaments may then be fastened together at the beginning on the template. The winding then begins with one of the sets of filaments so as to hide the other sets of filaments during at least one winding revolution. Subsequently, another set of filaments serves to produce at least one revolution so as to hide the other sets of filaments, and so forth, alternating. This also provides a striped rendering, for example such as rays, with stripes that may have different widths.

Once the entire template is wound, the sets of filaments thus create a woven structure around the entire corresponding template.

The method then for example includes a step for blocking the sets of filaments so as to prevent them from unwinding.

To that end, for example using a hook, the other ends of each of the filaments of the sets of filaments, for example called terminal ends, are pulled and hidden under at least one of the filament revolutions. The point where the filaments are introduced into the woven structure is potentially imbibed with a drop of transparent liquid adhesive. This immobilizes the filaments and prevents them from being freed from the structure.

A liquid adhesive, as mentioned in this application, is preferably shiny, water resistant, and completely transparent once dry. In the liquid state, it is possibly absorbed by the filaments, which harden and become immobilized, while avoiding leaving excess adhesive around them, which could happen with thick adhesive or gel, for example. One particularly convenient liquid adhesive is for example ethyl cyanoacrylate.

Figure 4:
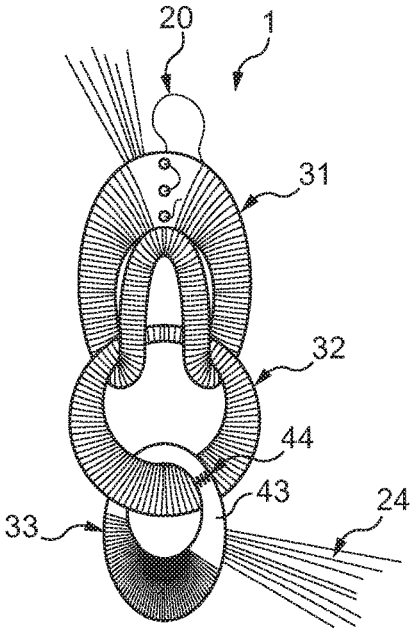
FIG. 4 illustrates a step for closing the previously open ring interwoven with another ring, and a step for finishing the winding of this ring after it is closed, as well as a step for fastening assembly filaments on the corresponding template.

If templates are interwoven in one another, as is the case here for the second template 42 and the third template 43, it is preferable first to wind the second template 42, which may be complete, then next to wind the third template 43 partially, i.e., leaving a template space not covered by filaments, as shown by FIGS. 3 and 4.

At this time, for example, the third template 43 is for example sectioned, i.e., cut so as to open the ring that it represents.

To that end, a cutout 44 is formed, here in the third template 43, going from the outer contour 43*a* to the inner contour 43*b* and in the entire thickness of the third template 43.

Of course, the cutout 44 can be made before beginning the windings, or even when the templates are drawn and cut out. However, it is preferable to wait for the winding of the template intended to be sectioned to be partly done before forming the cutout so as to make winding thereof easier.

Once the third template 43 is sectioned, it can then be interwoven with the second template 42.

One step then consists of closing the cutout 44, for example using a staple or sewing it, as shown in FIG. 4.

It is next possible to finish the winding of the third template 43.

Thus, as shown by FIGS. 3 and 4, the windings of the first template 41 and the second template 42 can be done independently of one another and independently of the winding of the third template 43.

However, it is for example more convenient to completely perform the winding of the first template 41, then to bend it, then to completely perform the winding of the second template 42, then lastly to perform partial winding of the third template 43, section it to open it and interweave it with the second template 42, then complete its winding.

Before or after the interweaving of the second template 42 with the third template 43, the second template 42 can be suspended from the first template 41, optionally even if the winding of the first template 41 is not complete, as shown by FIG. 4.

Indeed, in the example of FIG. 4, the step for winding the second template 42 here is complete when the second template is suspended from the first template 41, while the first template 41 and the third template 43 are still only partially wound.

Once the templates are created, wound, bent, optionally twisted and assembled to one another, an optional fastening step can be considered. This is for example of interest to prevent the rings from rotating around themselves relative to one another, in particular if charms or fasteners are attached to some rings. To that end, a stitch is for example made. To make the sewing as invisible as possible, the stitch can be made in the woven structure formed by the winding filaments and thus be hidden in the weaving of the filaments.

Figure 5:
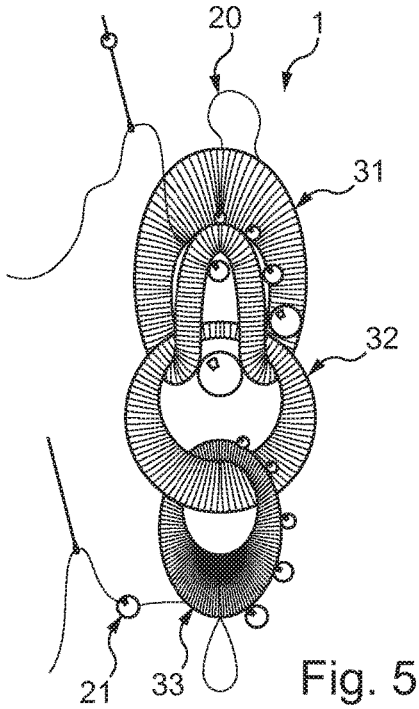
FIG. 5 illustrates a step for sewing pearls on the wound rings.
Figure 6:
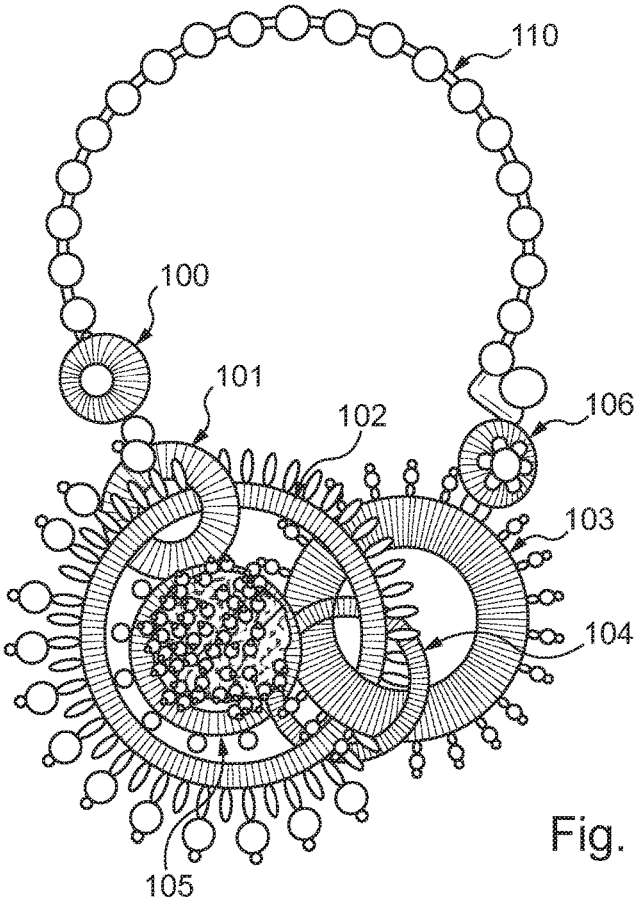
FIG. 6 is another schematic example of an ornamental piece according to one embodiment of the present invention.

As shown here in FIG. 5, it is next possible to embroider the rings formed from wound templates.

For example, with a needle and embroidery metal yarn, pierced stones or pearls 21 are embroidered on the woven structure, for example by making the embroidery metal yarn as invisible as possible in the same way as for the aforementioned sewing.

To that end, the stones or pearls 21 for example have a hole that allows them to be threaded and sewn on the template. The hole for example has a width of about 0.5 mm. The pearls 21 are for example freshwater pearls, precious, fine and ornamental pearls, or optionally synthetic pearls. The stones may also be precious stones or fine stones, or optionally synthetic stones.

The aforementioned stitching filament or embroidery metal yarn is for example made from woven or simple, transparent nylon or fluorine-carbon filament, with a diameter comprised between about 0.08 mm and about 0.25 mm and with a strength comprised between about 1 kg to 6.5 kg. Indeed, the filament used for the sewing and embroidery is preferably thin and transparent, while being as strong as possible to best prevent stones, pearls or the jewel from detaching due to breaking of the filaments.

FIG. 6 shows another example embodiment of an ornamental piece derived from a method as previously described. The ornamental piece of FIG. 6 is a necklace. The necklace of FIG. 6 includes several rings, including the rings identified by references 100 to 106. In this example embodiment, the rings 100 and 106 are end rings connected on either side of a chain or string of threaded pearls 110, which may include a clasp. The clasp is for example a pearl itself, for example an end pearl used as a button, which is surrounded by an elastic elastomer ring (for example made from rubber, nitrile, EPDM, silicone, polyurethane, for example Viton®). The elastic ring is possibly an O-ring also wound with colored filaments like the templates. The rings 100 and 106 are wound using the method previously outlined and a pearl, having a diameter larger than the inner contour of each of the templates, is next embroidered while forming a mask on the inner contour. Each ring 100 and 106 thus gives the impression of forming a halo around the pearl embroidered at its center.

The rings 101 to 105 are arranged as follows between the two end rings 100 and 106.

The first ring 101 is attached to the end ring 100 via a pearl and is also interwoven with the second ring 102.

The second ring 102 is interwoven not only with the first ring 101, but also with the third ring 103, which in turn is attached to the end ring 106 via a pearl.

Considering a front view of the necklace, the fourth ring 104 is juxtaposed behind the second ring 102 and in front of the third ring 103, while surrounding an intersection between the second ring 102 and the third ring 103 at which the third ring 103 passes above the second ring 102. The fourth ring is also interwoven with the fifth ring 105.

The fifth ring 105 is positioned within an inner contour of the second ring 102 and is connected thereto by pearls sewn on the one hand on an outer contour of the fifth ring 105 and on the other hand on the inner contour of the second ring 102. Furthermore, the fifth ring here is tangential to the first ring 101 and is simultaneously juxtaposed on part of the third ring 103.

An inside of the inner contour of the fifth ring 105 is further filled with a pearl embroidery. According to an alternative that is not shown, another entirely embroidered ring could, however, be positioned within the inner contour of the fifth ring 105.

Thus, for example here, the templates of the rings 100, 101, 103, 105 and 106 can be completely wound. The rings 100, 101, 103 and 106 are next positioned and optionally sewn to one another. The template of the second ring 102 is partially wound and sectioned to be interwoven with the first ring 101 and third ring 103, then its winding is completed. Then, for example, the template of the fourth ring 104 is partially wound and sectioned to be interwoven with the fifth ring 105 while passing through the third ring 103 and below the second ring 102, then its winding is complete.

The arrangement of the different rings can lastly be adjusted if necessary, then at least some of the rings sewn to others to maintain the desired effect. For example, the fifth ring 105 is sewn to the second ring 102 using pearls, then at least to the first ring 101, or optionally also to the third ring 103.

A step, for example a terminal step, next consists of adding additional embroidery.

Of course, the invention is not limited to the preceding description or the appended figures, but on the contrary encompasses any alternatives within the reach of one skilled in the art.

What is claimed is:

1. A method for producing an ornamental piece (1), comprising:

forming a first closed ring (32), including:

cutting out a first template (42) including a sheet of base material configured to be cut out and pierced, and at least partially winding the first template (42) with a first set of filaments (23);

forming a second open ring (33), including:

cutting out a second template (43) including a sheet of base material configured to be cut out and pierced, and partially winding the second template (43) with a second set of filaments (24);

intertwining the partially wound second ring (33) with the at least partially wound first ring (32); and closing the second ring (33);

characterized in that the second template (43) includes a cutout (44) and said closing the second ring (33) includes sewing the cutout (44) and finishing the winding of the second template (43).

2. The method according to claim 1, further comprising embroidering at least one of the first ring (32) or the second ring (33), in which at least one of the first template (42) or the second template (43) is pierced.

3. The method according to claim 1, further comprising folding at least one of the first template (42), at least partially wound, or the second template (43), at least partially wound.

4. The method according to claim 1, characterized in that at least one of the first template (42) or the second template (43) further includes foam configured to provide a thickness to the template, and at least one of the cutting out the first template (42) or the cutting out the second template (43) includes cutting out a first piece in the sheet of base material and cutting a second piece from foam, the second piece having a shape that is the same as the first piece, wherein the method further comprises gluing the first piece to the second piece.

5. The method according to claim 1, characterized in that at least one of:

the at least partially winding the first template (42) and the partially winding of the second template (43) includes;

gluing an initial end of at least one of the first set of filaments (23) or the second set of filaments (24) on one of the first template (42) or the second template (43) using a hot-melt adhesive.

6. The method according to claim 1, further comprising: finishing winding of the first template (42); wherein:

the finishing winding of the first template (42) or the finishing winding of the second template (43) includes gluing a terminal end of at least one of the first set of filaments (23) or the second set of filaments (24) on one of the first template (42) or the second template (43) using a liquid adhesive.

7. The method according to claim 1, further comprising: attaching a fastener (20) to one of the first template (42) or the second template (43), wherein: the attaching a fastener (20) is carried out before said at least partially winding of the first template (42) or said partially winding of the second template (43).

8. The method according to claim 7, further comprising: sewing the first ring (32) and the second ring (33) to one another.

9. A method for producing an ornamental piece (1), comprising:

forming a first closed ring (32), including:

cutting out a first template (42) including a sheet of base material configured to be cut out and pierced, and at least partially winding the first template (42) with a first set of filaments (23);

forming a second open ring (33), including:

cutting out a second template (43) including a sheet of base material configured to be cut out and pierced, and partially winding the second template (43) with a second set of filaments (24);

intertwining the partially wound second ring (33) with the at least partially wound first ring (32); and closing the second ring (33);

characterized in that:

at least one of the first template (42) or the second template (43) further includes foam configured to provide a thickness to the template, and at least one of the cutting out the first template (42) or the cutting out the second template (43) includes cutting out a first piece in the sheet of base material and cutting a second piece from foam, the second piece having a shape that is the same as the first piece, wherein the method further comprises gluing the first piece to the second piece.

10. The method according to claim 9, characterized in that at least one of:

the at least partially winding the first template (42) and the partially winding of the second template (43) includes:

gluing an initial end of at least one of the first set of filaments (23) or the second set of filaments (24) on one of the first template (42) or the second template (43) using a hot-melt adhesive.

11. The method according to claim 9, further comprising: finishing winding of the first template (42) and/or the second template (43); wherein:

the finishing winding of the first template (42) and/or the finishing winding of the second template (43) includes gluing a terminal end of at least one of the first set of filaments (23) or the second set of filaments (24) on one of the first template (42) or the second template (43) using a liquid adhesive.

12. The method according to claim 9, further comprising:

attaching a fastener (20) to one of the first template (42) or the second template (43), wherein:

the attaching a fastener (20) is carried out before said at least partially winding of the first template (42) or said partially winding of the second template (43).

13. The method according to claim 12, further comprising: sewing the first ring (32) and the second ring (33) to one another.

* * * * *